United States Patent [19]

Ueda et al.

[11] Patent Number: 4,829,716

[45] Date of Patent: May 16, 1989

[54] APPARATUS FOR AUTOMATICALLY PERFORMING PLURAL SEQUENTIAL SPHERICAL GRINDING OPERATIONS ON WORKPIECES

[75] Inventors: Shuji Ueda, Neyagawa; Kunio Nakata, Suita; Mamoru Inoue; Kazuhiko Fujino, both of Hirakata, all of Japan

[73] Assignee: Matsushita Electric Industrial Co. Ltd., Osaka, Japan

[21] Appl. No.: 865,864

[22] Filed: May 22, 1986

Related U.S. Application Data

[63] Continuation-in-part of Ser. No. 620,073, Jun. 12, 1984, abandoned.

[30] Foreign Application Priority Data

Oct. 22, 1985 [JP] Japan ..... 60-236054

[51] Int. Cl.[4] ..... B24B 13/00

[52] U.S. Cl. ..... 51/134; 51/3; 51/124 L; 51/237 T; 51/215 HM; 279/1 A; 279/50

[58] Field of Search ..... 51/129, 131.1, 134, 51/237 T, 3, 124 L, 215 R, 215 H, 215 M, 215 UE, 216 LP, 217 L; 279/1 A, 50

[56] References Cited

U.S. PATENT DOCUMENTS

| | | | |
|---|---|---|---|
| 2,493,206 | 1/1950 | Okey | 51/134 |
| 3,857,205 | 12/1974 | Van Hove | 51/134 |
| 3,977,131 | 8/1976 | Searle et al. | 51/237 T |
| 4,000,954 | 1/1977 | Patel | 279/50 X |
| 4,171,820 | 10/1979 | Klancnik | 279/50 |
| 4,434,582 | 3/1984 | Strauss et al. | 51/215 UE |

*Primary Examiner*—Robert P. Olszewski

*Attorney, Agent, or Firm*—Wenderoth, Lind & Ponack

[57] ABSTRACT

An apparatus for automatically performing plural sequential spherical grinding operations on workpieces such as optical lenses includes a machine base, an index table mounted on the machine base for rotation about an axis, a plurality of chuck units supported by the index table at positions equally spaced about the axis for grasping respective work pieces, and a conveyor for sequentially moving the workpieces adjacent the index table. A positioning device is located adjacent the conveyor for positioning sequentially workpieces to be ground at a selected position on the conveyor. A transfer device is positioned adjacent the conveyor and the index table to sequentially grasp individual workpieces at the selected position and transfer such workpieces sequentially to respective of the chuck units as the index table is rotated about the axis. The chuck units grasp or chuck the respective workpieces. A plurality of grinding units are mounted on the machine base at positions above the chuck units. A plurality of workpiece feed units are mounted on the machine base beneath the index table at positions corresponding to and aligned with positions of respective grinding units. Each feed unit clamps a respective chuck unit, rotates the same, and moves the same upwardly from the index table toward the respective grinding unit.

5 Claims, 3 Drawing Sheets

APPARATUS FOR AUTOMATICALLY PERFORMING PLURAL SEQUENTIAL SPHERICAL GRINDING OPERATIONS ON WORKPIECES

This is a continuation-in-part of Application Ser. No. 620,073, filed June 12, 1984, now abandoned.

BACKGROUND OF THE INVENTION

The present invention relates to a spherical surface grinding machine. More particularly, the present invention relates to a spherical surface grinding machine for grinding optical parts such as optical lenses, mirrors and so on at a desired radius of curvature.

FIG. 6 illustrates a typical conventional spherical surface grinding device that includes a collet chuck 1 for holding a lens blank 3, a rotary spindle 2 for rotating chuck 1 and blank 3 at a low speed, an inclined slide shaft 4 for tilting a high-speed rotary spindle 6 at a desired angle to blank 3, a parallel slide shaft 5 for adjusting the position of spindle 6, and a high-speed revolving diamond grinding stone 7. The blank 3 is ground by diamond grinding stone 7 to have a spherical surface with a predetermined radius of curvature.

In this arrangement, the glass lens blank is set in the chuck either manually by the operator or automatically by an auto-loader or the like and, after grinding the ground lens is removed from the chuck, again by the same manual or automatic means.

The diamond grinding stone is generally a cup-shaped metal bond stone in the range of about #100 to #300, which gives a finish roughness (Rmax) of 2 to 10 μm. This grinding process is followed by smoothing operations using diamond metal bond pellets and resinoid bond pellets and, in a final finishing operation, the lens is polished with a polyurethane or other polisher using $CeO_2$, ZrO or the like as an abrasive.

However, in the above prior art device, the lens blank 3 held by the collet chuck 1 can be ground only by a single diamond stone 7, and when the ground lens is to be further finish-ground it is necessary to either replace the stone with a finishing stone or transfer the lens to another spherical surface grinding device or unit. However, as the lens blank has been subjected to a hot molding process, it is not advisable to again grasp or hold the lens with a collet chuck and, moreover, a change in chucking position of the lens is inevitable. This demands a large finish grinding margin or tolerance and the efficiency of rough and finish grinding is adversely affected.

Moreover, it is not easy to discriminately apply the forced cutting mode, i.e. constant feed rate, made in a rough grinding operation or the constant-pressure cutting mode in a finish grinding operation, these modes being the most effective modes for the respective processes, with the result that a satisfactory finished spherical surface cannot be achieved. Another disadvantage is that the device cannot be operated according to a programmed time-schedule or in a tract system.

SUMMARY OF THE INVENTION

The object of the present invention is to overcome the above-mentioned and other disadvantages of the prior art and to provide an apparatus for automatically performing plural sequential spherical grinding operations on workpieces, particularly optical workpieces such as optical lenses, whereby it is possible to produce a satisfactorily finished spherical surface with improved efficiency.

This object is achieved in accordance with the present invention by the provision of an apparatus including a machine base, an index table mounted on the machine base for rotation about an axis, a plurality of chuck units supported by the index table at positions equally spaced about the axis for grasping respective workpieces, conveyor means for sequentially moving the workpieces adjacent the index table, positioning means adjacent the conveyor means for positioning sequentially workpieces to be ground at a selected position on the conveyor means, transfer means, positioned adjacent the conveyor means and the index table, for sequentially grasping individual workpieces at the selected position and for transferring such workpieces sequentially to respective of the chuck units as the index table is rotated about the axis, the chuck units grasping respective such workpieces. A plurality of grinding units are mounted on the machine base at positions above the chuck units, each grinding unit including a grinding tool, means for rotating the grinding tool, and rectilinear and pivotable slide means for adjusting the position of the grinding tool with respect to a respective workpiece. A plurality of workpiece feed units are mounted on the machine base beneath the index table at positions corresponding to and aligned with positions of respective of the grinding units. Each feed unit includes means for clamping a chuck unit thereabove, means for rotating the thus clamped chuck unit, and means for moving the thus clamped chuck unit upwardly from the index table toward the respective grinding unit, such that the workpiece grasped by the chuck unit is moved upwardly into contact with the respective grinding tool. The moving means of the feed units are different from each other.

In a preferred arrangement of the present invention, particularly when applied for grinding optical lenses, the plurality of workpiece feed units comprise first and second feeding units, the moving means of the first feed unit comprising means for urging the respective work piece toward the respective grinding tool in a forced cutting function, i.e. at a forced constant race. The moving means of the second feed unit comprises means for urging the respective workpiece toward the respective grinding tool at a constant pressure.

The index table is indexed about the axis to sequentially align each of the chuck units with each of the grinding units and the respective feed units.

BRIEF DESCRIPTION OF THE DRAWINGS

Other objects, features and advantages of the present invention will be apparent from the following detailed description of a preferred embodiment, with reference to the accompanying drawings, wherein.

DETAILED DESCRIPTION OF THE INVENTION

Figure 2:
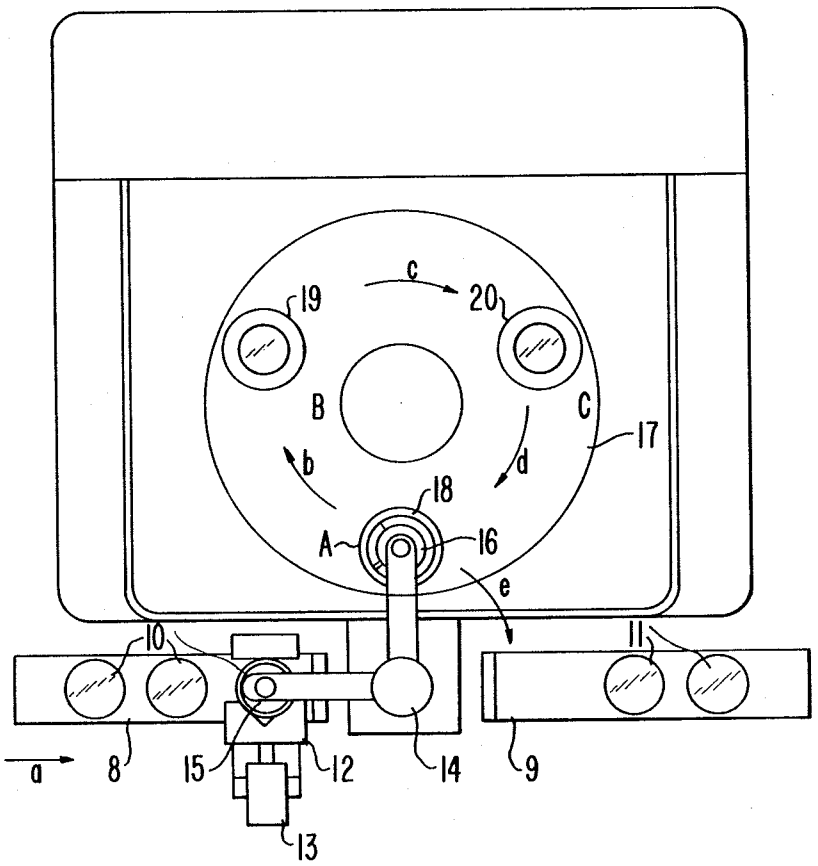
FIG. 2 is a partial plan view thereof, particularly illustrating the transfer of workpieces to be ground from a conveyor to an indexing portion of the apparatus and transfer of finished ground workpieces from the indexing portion of the apparatus to a conveyor.

Referring first to FIG. 2, which is a plan view showing the manner of transfer of workpieces, the reference numerals 8, 9 indicate a conveyor system for transporting the workpieces, i.e. lens blanks and finished lens. The lens blanks are indicated by the numeral 10, while the finished lenses are indicated at 11. The finished lenses are successively transported to a subsequent processing stage. The machine or apparatus according to this embodiment includes a workpiece stop or positioning unit 12 disposed over the conveyor and driven by a drive cylinder 13 to stop a lens 10 at a selected position, an auto-hand or transfer device 14 adapted to rotate through 90 degrees and having a pair of arms terminating in suction heads 15 and 16 adapted to grasp the lenses by suction and transport them. The machine further includes a rotary indexing table 17 which is index-driven about an axis at an angular pitch of 120 degrees to transport chuck units 18, 19 and 20 each adapted to hold a workpiece.

Thus, the workpiece 10 transported in the direction a on conveyor 8 is positioned by the workpiece positioning unit 12, grasped by the suction head 15, swung through 90 degrees, and chucked by the chuck unit 18. When the rotary indexing table 17 is index-driven in the direction b, the chuck unit 18 is located at a predetermined processing position where the workpiece is rough-ground by a grinding unit or means to be described hereinafter. Then, the indexing table 17 is indexed in the direction of c to a predetermined processing position where the same workpiece is precision-ground by another grinding unit or means. The indexing table 17 is then index-driven in the direction of d to a predetermined position where the finished lens is grasped by the suction head 16 of the auto-hand 14 and, by the rotation of the auto-hand 14 in the direction of e, is placed on the conveyor 9.

Figure 1:
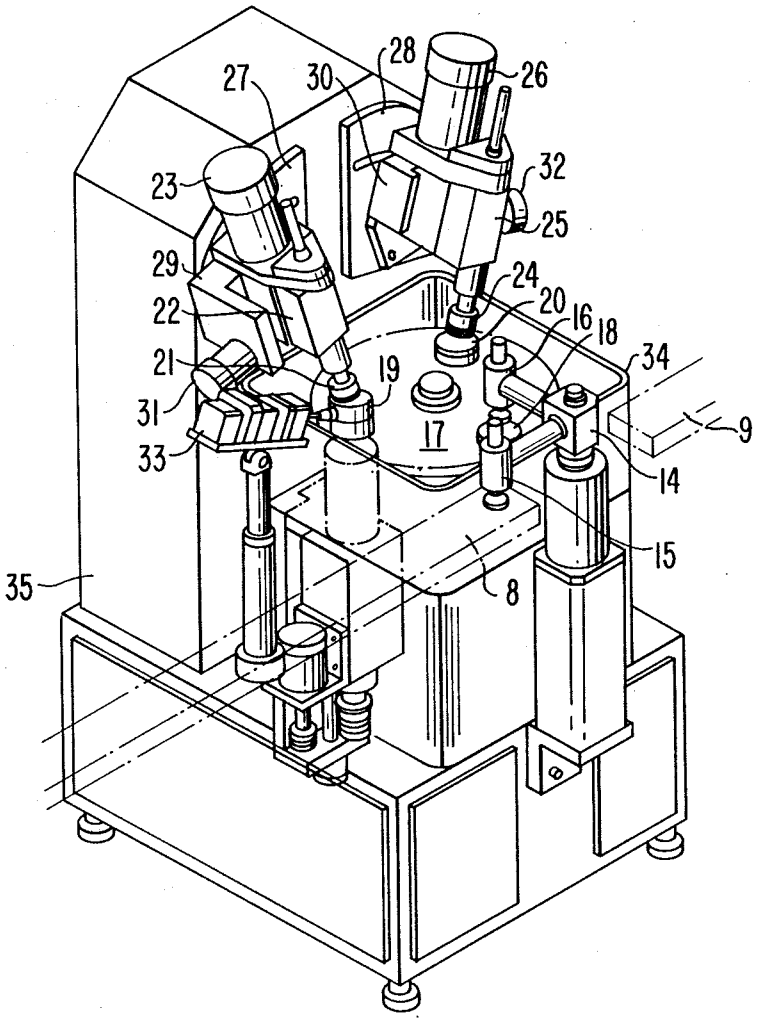
FIG. 1 is a perspective view illustrating an apparatus according to the present invention.

FIG. 1 is a perspective view showing a spherical surface grinding apparatus or machine embodying the above workpiece transport principle according to the present invention. This spherical surface grinding machine includes lens conveyor system 8, 9, auto-hand 14 equipped with suction heads 15 and 16, rotary indexing table 17, and chuck units 18, 19 and 20 each adapted to chuck a workpiece and to be transported by rotary indexing table 17. A rough grinding tool such as diamond stone 21 is attached to a rotary spindle 22 and is thereby rotated at a speed of 12,000 to 36,000 r.p.m. A drive motor 23 is associated with the rotary spindle 22 to drive the same. The reference numerals 27 and 28 indicate tilting or pivotable slide members for tilting rough-grinding diamond stone 21 and a precision-grinding diamond stone 24, respectively, in such a manner that the workpiece may be machined to a spherical surface with a predetermined radius of curvature, and each tilting slide member is index-driven by a respective drive motor (not shown) and locked in position. The reference numerals 29 and 30 are parallel slides for setting the respective associated grinding stones in such a manner that the peripheral portin of the stone may come into contact with the center of the workpiece. Indicated at 31 and 32 are drive motors associated with parallel slides 29 and 30, respectively. Thus, the parallel slides are index-driven by motors 31 and 32, respectively, and locked in position. Built into the machine under the indexing table 17 are lens feeding mechanisms adapted to clamp respective chuck units holding the respective workpieces, rotate the clamped chuck units at a speed of 10 to 60 r.p.m. and drive the chuck units towards the respective revolving grinding stones, as will be described in detail hereinafter. Indicated at 33 is a chamfering head for chamfering which is performed at the same time as rough grinding. A grinding fluid receptacle 34 and a machine body base 35 also are shown.

Figure 3:
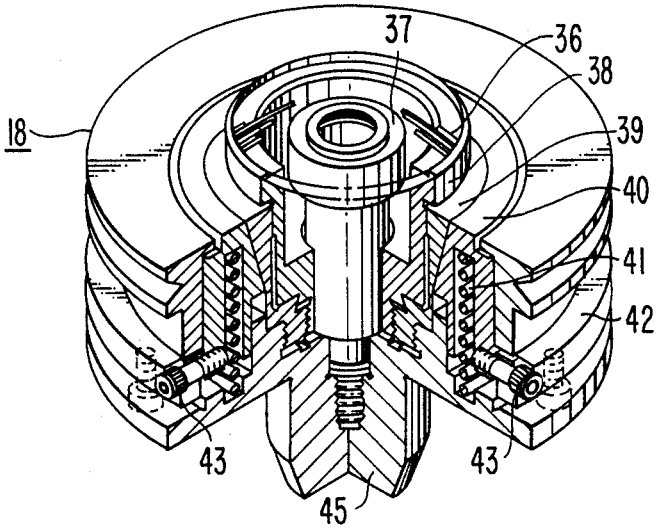
FIG. 3 is a perspective view, partially in section, of a chuck unit thereof.

FIG. 3 is a perspective view showing chuck unit 18 which is transported by the rotary indexing table 17, chuck units 19 and 20 being of similar construction. The reference numeral 36 indicates a workpiece, such as a lens blank or a lens in process. The chuck unit includes a control ring 37 which controls the chucked height of the workpiece 36, a chuck ring 38 adapted to grasp or clamp the periphery of the workpiece 36, a collet 39 adapted to open and close the chuck ring 38, and a tapered ring 40 having a built-in compression spring 41 for moving collet 39 in such a manner that the tapered ring 40 is urged upwardly relative to collet 39 to thus cause collet 39 to fasten or tighten the chuck ring 38 about the periphery of workpiece 36. An outer ring 42 is connected with tapered ring 40 through bolts 43. When inserting the workpiece 36 into the chuck unit or withdrawing it from the chuck unit, the chuck ring 38 must be set in the open position. For this purpose, the outer ring 42 is depressed, whereupon the tapered ring 40 is also lowered to receive the collet 39 and, hence, open the chuck ring 38. Indicated at 45 is a chuck unit base.

Figure 4:
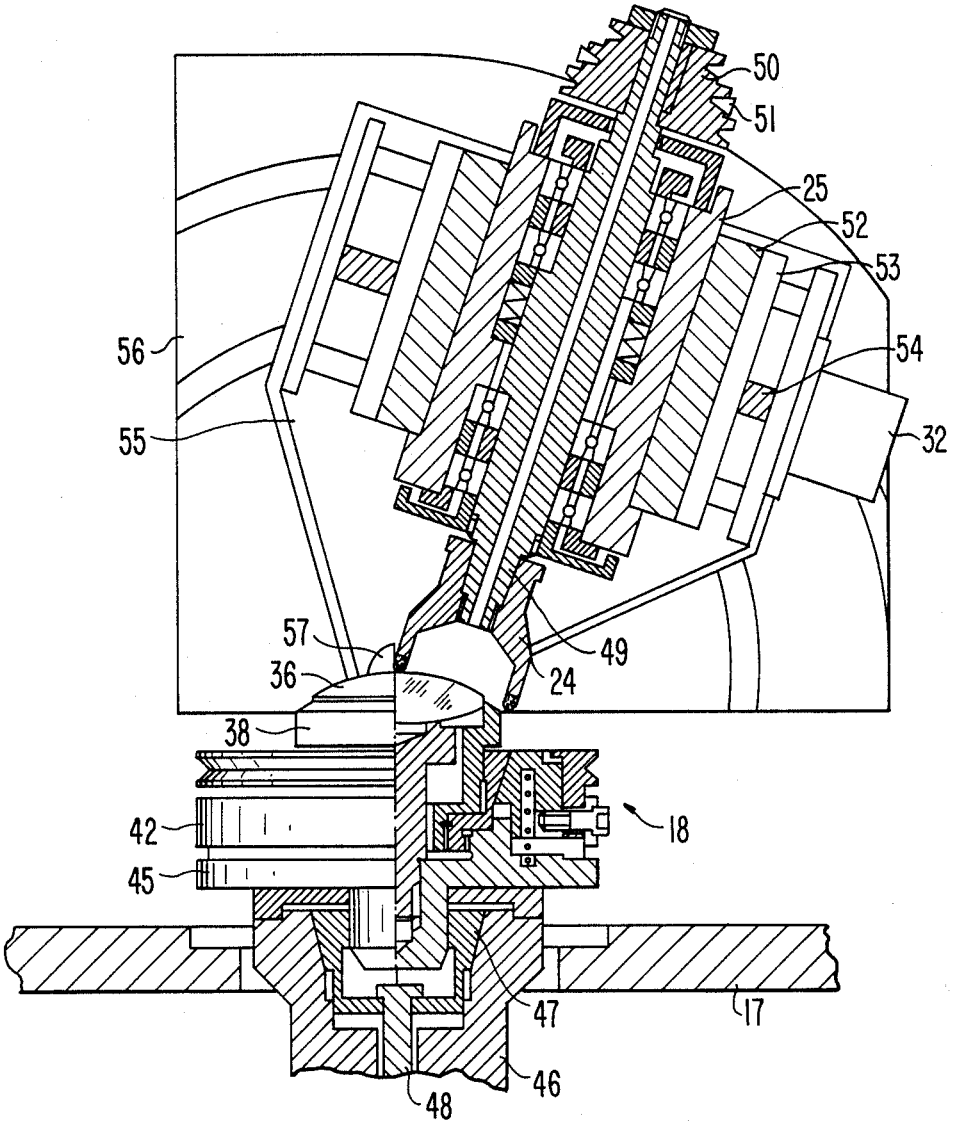
FIG. 4 is a partial sectional view of one grinding unit, one chuck unit and part of a feed unit.

The workpiece 36 chucked by the above-described chuck unit 18 is brought into grinding association with the respective diamond grinding stone for rough grinding or precision grinding. The rotary spindle for driving the diamond grinding stone at a high rotational speed and the feeding mechanism for establishing such grinding association are shown in FIG. 4. As mentioned hereinbefore, the numeral 36 indicates the workpiece, 38 the chucking ring, 42 the outer ring, and 45 the chuck unit base. The chuck unit is clamped to a rotary shaft 46 of the feeding mechanism by means of a collet chuck 47 and is driven towards the respective diamond grinding stone, FIG. 4 shows grinding stone 24, as it is rotated. The rotary indexing table 17 transports the chuck unit to a position immediately over the feeding mechanism or unit. Reference numeral 48 indicates a clamp shaft for actuating the collet chuck 47.

The diamond grinding stone 24 is mounted on a rotary shaft 49 of rotary spindle 25 and is driven at a high speed, e.g. of 12,000 to 36,000 r.p.m., by drive motor 26 (FIG. 1) via a pulley 50 and a belt 51. Rotary spindle 25 is fixedly secured to a spindle holder 52 which, in turn, is fixedly secured to a parallel slide table 53 of parallel slide 30 (FIG. 1). As illustrated, the parallel slide table 53 for shifting the diamond grinding stone 24 in a direction perpendicular to its axis of rotation to bring the periphery of the grinding stone 24 into contact with the center of rotation of the workpiece 36 is index-driven by a drive motor 32 via a ball screw 54 to a predetermined position. This parallel slide is disposed on a swing table 55 of swing slide member 28 (FIG. 1) The swing table 55 is angularly driven by a drive motor (not shown) about a pivot 57 with respect to a swing slide base 56. The rotary spindle assembly for diamond grinding stone 21 is of similar construction.

Figure 5:
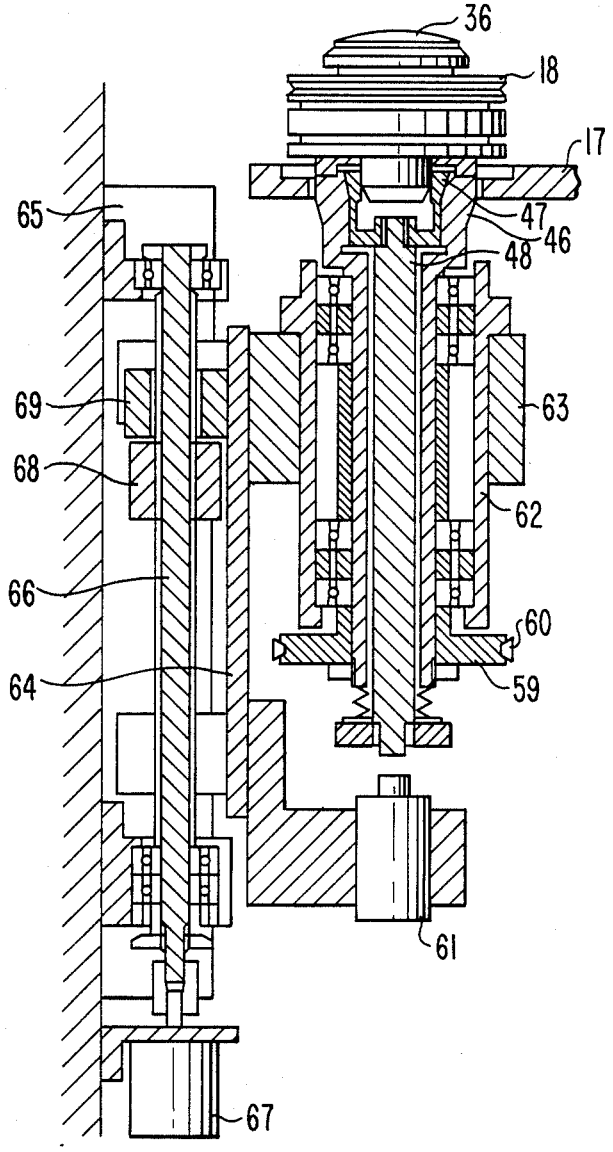
FIG. 5 is a partial sectional view of a feed unit thereof.
Figure 6:
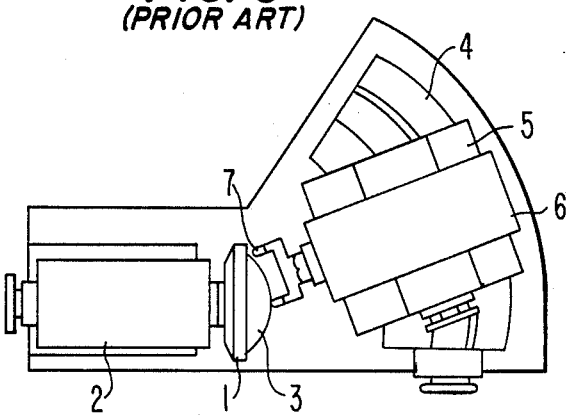
FIG. 6 (PRIOR ART)
FIG. 6 is a plan view of a prior art grinding apparatus.

FIG. 5 is a sectional view showing the workpiece feeding mechanism or unit which rotates and feed the workpiece chucked by the respectiv chuck unit into grinding association with the respective diamond grinding stone.

The chuck unit 18 carrying the workpiece 36 is transported by the rotary index table 17 to a position aligned with the respective grinding and feed units in the manner discussed above. The chuck unit then is removed from support by index table 17 and is grasped by the respective collet chuck 47. Specifically, a cylinder 61 is actuated to thereby push upwardly the clamp shaft 48. This moves collet chuck 47 upwardly, and at the same time moves chuck unit 18 upwardly from index table 17. The movement of the collet chuck 47 upwardly releases the collet chuck so that it surronds chuck unit base 45. With this condition maintained, rotary shaft 46 is moved upwardly. Specifically, a drive motor 67 rotates a ball screw 66 to thereby raise a nut 68 fixed to a vertical slide table 64 supporting a spindle holder 63 surrounding a rotary spindle 62 which supports rotary shaft 48 via bearings. Upon shaft 46 being moved upwardly to a level above a recess in index table 17, cylinder 61 is actuated to withdraw the piston rod thereof, thereby causing a spring to urge shaft 48 downwardly, thereby closing collet chuck 47 within a recess in shaft 46. As a result, the collet chuck 47 grasps the base 45 of the chuck unit 18. Thereby, the chuck unit is supported by shaft 46, rather than by index table 17. Continued operationof drive motor 67 causes further upward movement of shaft 46 and chuck unit 18, as a result of which workpiece 36 is moved upwardly toward the respective grinding stone. Shaft 46 is rotated at a relatively low speed, for example 10 to 60 r.p.m., by a drive motor via a pulley 59 and a belt 60.

The above description refers to the feed mechanism for the rough grinding operation, i.e. feeding of the workpiece at a constant rate. The feed unit for achieving precision grinding is modified to achieve feeding of the workpiece at a constant pressure, and this modification will be apparent from a further consideration of FIG. 5. Thus, member 68 is not secured to vertical slide table 64, but rather a bracket 69 is disposed immediately above the upper end face of nut 68 and is secured fixedly to the vertical slide table 64. High pressure gas, for example air, is introduced into the clearance between the upper end face of nut 68 and the bracket 69 so that the unit as a whole including spindle holder 64, rotary spindle 62, rotary shaft 46, collet chuck 47, the chuck unit and the respective workpiece, is maintained in a floating state, thereby enabling the workpiece to be fed at a constant pressure. Such arrangement is suitable for precision grinding.

Although it is believed that the overall operation of the device of the invention will be apparent from a consideration of the above, such overall operation now will be summarized.

First, suction head 15 of auto-hand 14 graps a workpiece 10 maintained at a selected position on conveyor 8 by work positioning unit 12. The auto-hand 14 is rotated 90 degrees clockwise from the position shown in FIG. 2 to insert the grasped workpiece into chuck unit 18 supported on rotary index table 17. At the same time, a previously finished ground workpiece 11 is grasped by suction head 16 and rotated in direction e by the other arm of the auto-hand and is deposited on conveyor 9.

The indexing table 17 then is rotated in direction b. During this movement, the outer ring 42 of chuck unit 18 is depressed and then raised, to ensure that the chuck ring chucks the workpiece in position. This would be achieved by any means that would be understood by one skilled in the art, such as by a cam bar or a pair of levers positioned adjacent the periphery of table 17, for example fixed to base 35. The chuck unit 18 which has thus chucked the workpiece 10 continues movement in the direction b to a position B aligned with the rough grinding station and the respective feed unit. The feed unit then is operated in the above described manner to grasp the base 45 of the chuck unit, to raise the chuck unit above support by index table 17, to rotate the chuck unit and the thus supported workpiece 36 at a relatively low speed, while the workpiece is fed toward rough grinding stone 21 at a constant rate by motor 67, ball screw 66 and the above described associated elements. Thereby, rough grinding of the workpiece 36 is achieved by the grinding stone 21.

Upon completion of the rough grinding operation, motor 67 is reversed to lower the shaft 46 to a level such that the upper portion of the collet chuck 47 releases outwardly, thereby enabling the chuck unit 18 again to be supported by index table 17. Once this is achieved, index table 17 then moves chuck unit 18 in the direction c to the position c where a precision grinding operation is performed by the same sequence of operations described above. The feeding unit at the precision grinding station however feeds the workpiece at a constant pressure, rather than at a constant rate.

After completion of the precision grinding operation by the carrying out of the above sequence of operations at station C, the index table 17 again moves the chuck 18 in the direction d to the position A, whereat the finished workpiece or lens 11 is engaged by suction head 16 of the auto-hand 14, which then rotates clockwise by 90 degrees from the position shown in FIG. 2, in the manner discussed above, to deposit the finished lens 11 on conveyor 9, to thereafter transfer the finished lens to the next processing stage.

It will be understood that the above grinding operations include selective control of the rectilinear and pivotable slides 29,30 and 27, 8 in the manner described above to achieve a particular spherical grinding operation.

In accordance with the apparatus described above, it is possible to achieve a surface roughness Rmax 0.1 $\mu$m in a relatively easy manner in a tact time of 25 seconds. Furthermore, the entire grinding operation is achieved in a continuous and sequential manner.

Accordingly, with the present invention it is possible to achieve a satisfactorily finished surface automatically, and after-processing operations can be simplified or eliminated. The present invention therefore contributes substantially to grinding precision and to reduced production costs.

Although the present invention has been described and illustrated with respect to preferred features thereof, it is to be understood that numerous modifications and changes may be made to the specifically described and illustrated features without departing from the scope of the present invention.

What we claim is:

1. An apparatus for automatically performing plural sequential spherical grinding operations on workpieces, particularly optical workpieces such as optical lenses, said apparatus comprising:

a machine base;

an index table rotatably mounted on said machine base for rotation about an axis;

a plurality of chuck units supported by said index table at positions equally spaced about said axis for grasping respective workpieces;

conveyor means for sequentially moving workpieces adjacent said index table;

positioning means adjacent said conveyor means for positioning sequentially workpieces to be ground at a selected position on said conveyor means;

transfer means, positioned adjacent said conveyor means and said index table, for sequentially grasping individual workpieces at said selected position and for transferring such workpieces sequentially to respective said chuck units as said index table is rotated about said axis, said chuck units grasping respective such workpieces;

a plurality of grinding units mounted on said machine base at positions above said chuck units, each said grinding unit including a grinding tool, means for rotating said grinding tool, and rectilinear and pivotable slide means for adjusting the position of said grinding tool with respect to a respective workpiece; and a plurality of workpiece feed units mounted on said machine base beneath said index table at positions corresponding to and aligned with positions of respective said grinding units, each said feed unit including means for clamping a said chuck unit thereabove, means for rotating the thus clamped chuck unit and means for moving said thus clamped chuck unit upwardly from said index table toward the respective said grinding unit, such that the workpiece grasped by said chuck unit is moved upwardly into contact with the respective said grinding tool, said moving means of said feed units being different from each other.

2. An apparatus as claimed in claim 1, comprising first and second said feed units, said moving means of said first feed unit comprising means for urging the respective workpiece toward the respective said grinding tool at a forced constant rate, and said moving means of said second feed unit comprising means for urging the respective workpiece toward the respective said grinding tool at a constant pressure.

3. An apparatus as claimed in claim 1, further comprising means for indexing said index table about said axis to sequentially align each said chuck unit with each said grinding unit and the respective said feed unit.

4. An apparatus as claimed in claim 1, wherein each of said chuck units comprises a chuck ring having an inner peripheral surface along which a respective workpiece is grasped, and collet means extending around said chuck ring for urging said inner peripheral surface into contact with the respective workpiece and for allowing said inner peripheral surface to be moved out of contact with the respective workpiece.

5. An apparatus as claimed in claim 4, wherein said collet means includes a tapered collet extending around and contacting said chuck ring, a ring means extending around said collet and having an inner peripheral surface contacting said collet, and a spring means connected to said ring means for urging said inner peripheral surface of said ring means against said tapered collet, said spring means extending in the direction in which said collet is tapered.

* * * * *